United States Patent [19]

Johnson

[11] 4,364,372

[45] Dec. 21, 1982

[54] TRIPOD TORCH HANDLE

[76] Inventor: Joseph N. Johnson, 2795 N. Ludlow, Urbana, Ohio 43078

[21] Appl. No.: 179,934

[22] Filed: Aug. 19, 1980

[51] Int. Cl.[3] ..... F24C 3/00

[52] U.S. Cl. ..... 126/39 R; 126/91 A; 126/40; 431/351

[58] Field of Search ..... 126/91 R, 91 A, 39 R, 126/9 R, 40; 431/353, 351

[56] References Cited

U.S. PATENT DOCUMENTS 1,311,235 7/1919 Kemp et al. ..... 126/91

2,469,185 5/1949 Tullis ..... 431/353

3,598,512 9/1971 Johnson ..... 126/271.2 R

*Primary Examiner*—Carroll B. Dority, Jr.

*Attorney, Agent, or Firm*—Harvey B. Jacobson

[57] ABSTRACT

A torch type heating device has a removably mounted grid and pivotally attached handle assembly convertible to a tripod support to facilitate installation as a cooking apparatus and as part of a space heater assembly. Shields mounted adjacent opposite ends of the torch tube associated with the heating device, render the heating device wind-proof.

16 Claims, 6 Drawing Figures

TRIPOD TORCH HANDLE

BACKGROUND OF THE INVENTION

This invention relates to heating devices of the torch type and is an improvement over a torch type heating device disclosed in my prior U.S. Pat. No. 3,598,512.

Torch type heating devices are well-known as indicated by way of example in my prior U.S. patent aforementioned. The tripod mounting of any tubular device whether it be a heating torch or some other device is also well-known as disclosed, for example, in U.S. Pat. Nos. 307,640 and 3,239,176. Another tripod support for equipment of the type involved herein is disclosed in U.S. Pat. No. 3,475,109.

The prior art tripod supports as aforementioned are not directly related to adjustment of heat torch mountings that present special mounting problems and installational requirements that often restrict use of the heat torch. Further, installational mountings for heat torches often create dangerous conditions and prevent easy handling and control of the heating devices from a functional standpoint.

It is therefore an important object of the present invention to provide a torch type heating device and associated apparatus which will extend the utility of the torch device without creating any dangerous installational problems as well as to provide a measure of safety and heat control.

SUMMARY OF THE INVENTION

In accordance with the present invention, a torch tube enclosing a burner unit has a support grid or grill removably secured thereto adjacent one axial end from which heat is emitted. The grid is positioned on the torch tube by guide rods, some of which project from the other axial end of the torch tube to act as stops engageable with a handle assembly. A clamp holds the guide rods in place on the tube. The handle assembly is convertible to a tripod support for the torch tube in a vertical position. The handle assembly includes tripod legs, one of which is pivotally connected to the torch tube at a single pivot axis adjacent the end from which the burner unit projects so as to enable the tripod legs to be folded into a retracted condition at an acute angle to the torch tube with the legs held parallel to each other. In the retracted condition of the handle assembly, it may be received within a retainer associated with a horizontal radiator tube on which the torch tube is mounted to form a space heater apparatus. Annular and disc-shaped shields adjacent opposite axial ends of the torch tube render the apparatus wind-proof.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF DRAWING FIGURES

DETAILED DESCRIPTION OF PREFERRED EMBODIMENT

Figure 1:
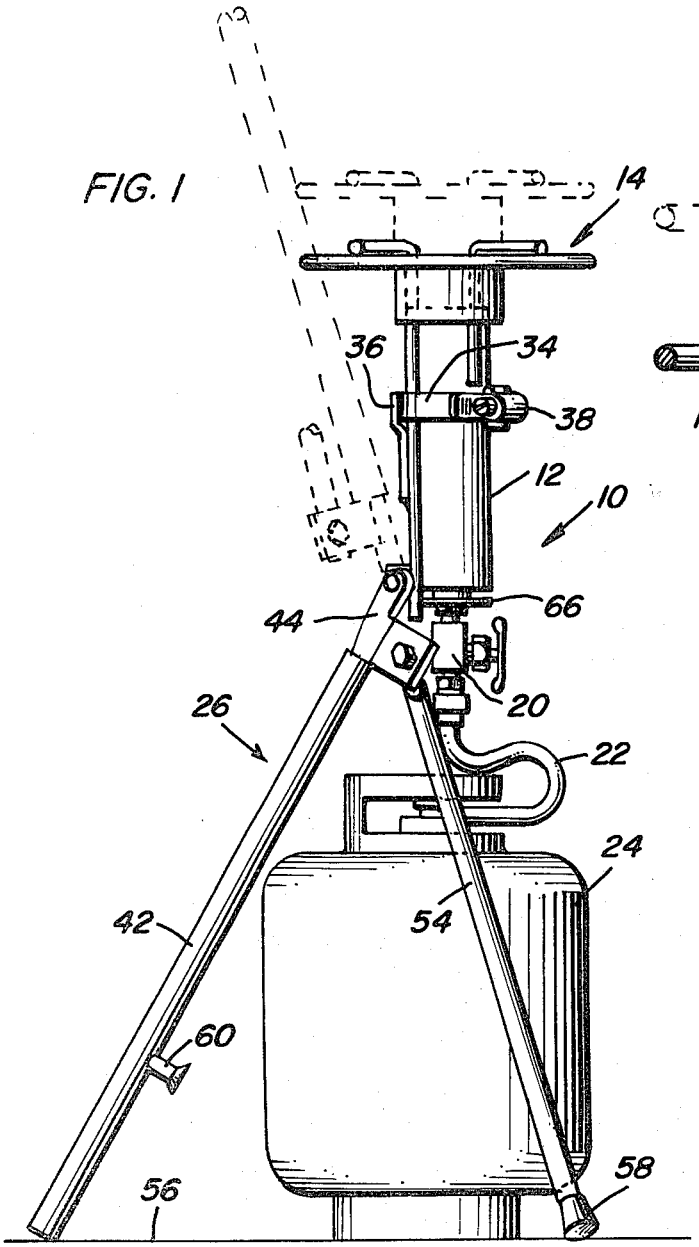
FIG. 1 is a side elevation view of a tripod torch assembly in a cooking mode of operation.

Referring now to the drawings in detail, FIG. 1 illustrates one installation for a heating torch generally referred to by reference numberal 10. The heating torch includes a vertically positioned torch tube 12 on which a cooking support grid or grill 14 is mounted adjacent the upper axial end. A conventional type of burner unit generally referred to by reference numeral 16 in FIG. 2 projects from the lower axial end 18 of the torch tube and is connected to a manually operable fuel control valve 20 to which a flexible fuel supply conduit 22 is coupled. In the installation shown in FIG. 1, the fuel supply conduit 22 extends from a fuel tank 24 positioned below the torch tube 12 supported in a vertical position by a handle assembly 26 in an extended, tripod supporting condition as shown in FIG. 1.

Figure 2:
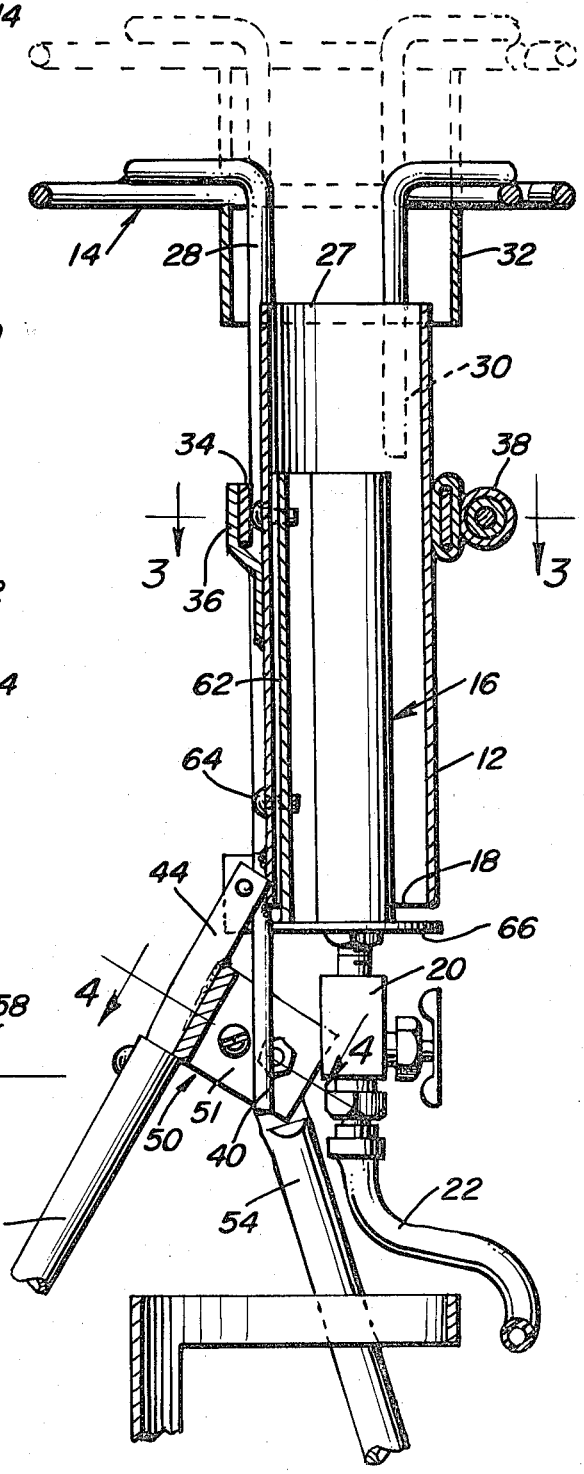
FIG. 2 is an enlarged side section view through a portion of the apparatus shown in FIG. 1.
Figure 3:
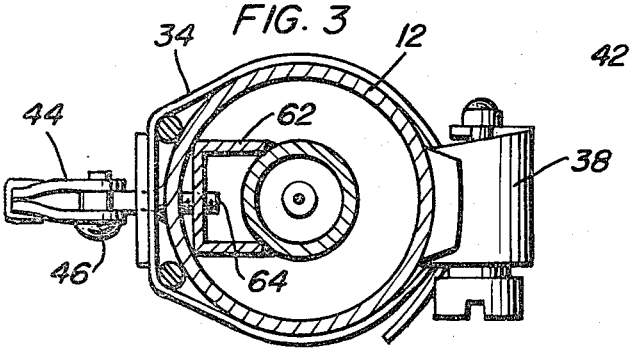
FIG. 3 is a transverse section view taken substantially through a plane indicated by section line 3—3 in FIG. 2.

As more clearly seen in FIGS. 2 and 3, the grid or grill 14 is generally circular in shape and made of a suitable rod-like material. The grid is mounted in spaced relationship to the upper, heat-emitting axial end 27 of the torch tube 12 by means of a pair of elongated slide rods 28 secured to, as by welding, to the grid and engaging the tube 12 on its external surface. A pair of shorter guide rods 30, also welded to the grid 14, project axially from the grid into engagement with the external surface of the torch tube to operatively position the grid 14 closely above the upper axial end 27 of the torch tube as shown in FIG. 2. An annular shield 32 is secured, as by welding, to the rods 28 and 30 in order to form a protective enclosure extending downwardly from the grid 14 into axially overlapping relationship to the upper end portion of the torch tube. The grid 14 is operatively positioned in adjustably spaced relationship to the torch tube by a clamp band 34 seated within a bracket 36 fixed to the tube 12 intermediate opposite axial ends 18 and 27. A releaseable clamp device 38 connected to the band 34 maintains it under tension in embracing relationship to the tube 12 in order to hold the rods 28 in adjusted axial positions on the external surface of the tube 12. The lower end portions 40 of the rods 28 act as stops engageable with the handle assembly 26 to lock it in its extended tripod supporting condition under load to thereby establish a substantially rigid and stable support for the torch tube.

Figure 4:
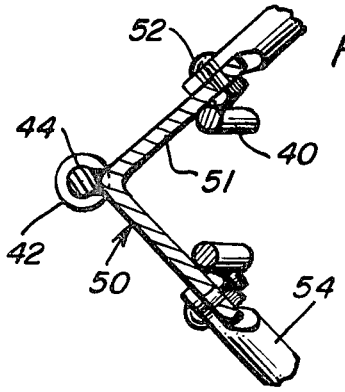
FIG. 4 is a transverse section view taken substantially through a plane indicated by section line 4—4 in FIG. 2.

Referring now to FIGS. 1, 2 and 4, the handle assembly 26 includes an elongated leg element 42 having an upper clevis portion 44 that is interconnected by a pivot pin 46 to a pivot flange projecting from the torch tube 12 adjacent its lower axial end 18. Secured to the upper portion 44 of the leg element, closely spaced below the torch tube, is a hinge bracket 50. As more clearly seen in FIG. 4, the hinge bracket 50 is secured as by welding to the upper portion 44 of the leg element at its vertex between diverging arms 51 supporting pivot connections 52 connected to the upper end portions of a pair of tripod legs 54. When the tripod legs 54 are extended in angular relationship to the leg element 42 and diverge therefrom as shown in FIGS. 1 and 4, the hinge bracket 50 is engaged by the lower end portions 40 of the rods 28 to thereby form a substantially rigid and stable vertical support for the torch tube. In the tripod supporting condition of the handle assembly, the lower ends of the tripod legs and leg elements rest on a horizontal surface 56. The lower ends of the tripod legs may be provided with rubber-like feet 58 while a spacer element 60 may be secured to the leg element 42 for spacing the tripod legs when retracted into positions closely spaced in substantially parallel relation to the leg element 42 as shown by dotted line in FIG. 1 and as shown by solid line in FIGS. 5 and 6.

In the installation shown in FIGS. 1–4, the heating device 10 will be operated as a cooking apparatus. Food, for example, may be placed on top of the grid 14 so as to receive heat emitted from the upper axial end 27 of the torch tube, the heat being generated by the burner unit 16 positioned in spaced relationship to the torch tube by a spacer 62 and fasteners 64 as more clearly seen in FIGS. 2 and 3. Secured to the burner unit 16 at its lower end closely spaced below the lower fuel receiving end 18 of the torch tube is a disc-shaped windshield 66 as more clearly seen in FIG. 2. The windshield 66 effectively prevents extinction of the burner flame by air currents and protectively shields the torch tube from the fuel control valve 20 interconnected between the fuel supply conduit 22 and the lower end of the burner unit 16.

Figure 5:
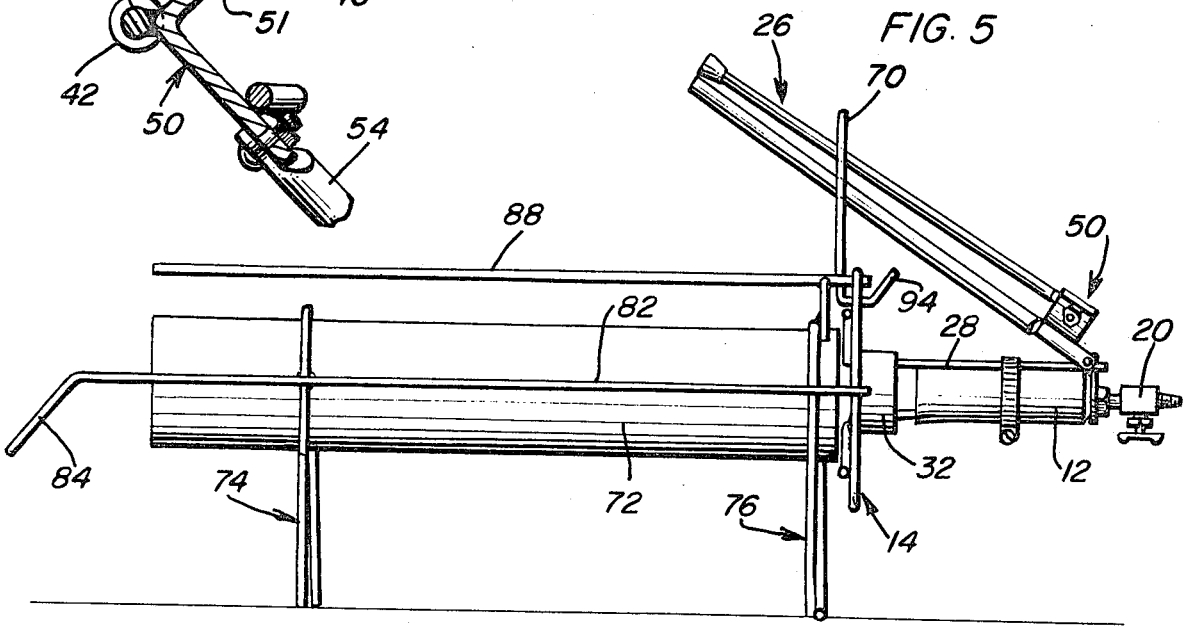
FIG. 5 is a side elevation view of the torch heating device associated with a space heater assembly.

With the leg element 42 and tripod legs 54 in the retracted condition, the handle assembly 26 may enable one to carry the apparatus to another location. Further, the retracted handle assembly 26 may be folded back at an acute angle to the torch tube 12 so as to be received through a retainer loop 70 associated with a horizontal space heater installation as shown in FIGS. 5 and 6.

The space heater installation includes a horizontally positioned heat radiator tube 72 to which support leg assemblies 74 and 76 are secured as by welding. Each of the support leg assemblies includes a rod-like element having a portion 78 embracing the tube 72 and a pair of crossing support legs 80. The support leg assemblies 74 and 76 are interconnected in spaced relationship to each other by horizontal rod portions 82 which also prevent unintentional contact with the radiator tube 72 at its sides. The rod portions 82 are interconnected by a loop handle portion 84 in spaced relationship to one axial end 86 as shown in FIG. 5. The upper portion of the radiator tube 72 is protected against contact by a pair of rods 88 interconnected with the leg assembly 76 adjacent an axial end 90 of the tube 72 by means of connecting rod sections 92. The rods 88 are secured, as by welding, to the retainer loop 70 adjacent the axial end 90 as more clearly seen in FIG. 6.

Figure 6:
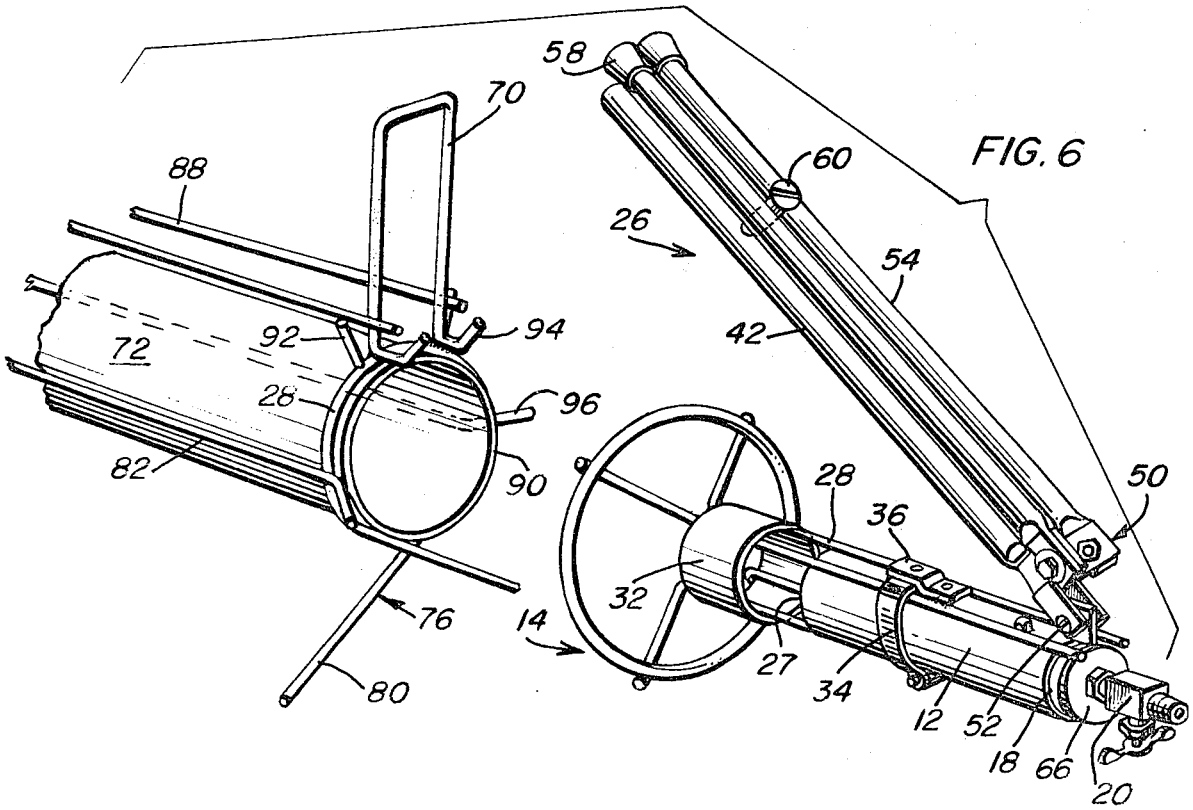
FIG. 6 is a perspective view showing the disassembled components associated with the assembly shown in FIG. 5.

Grid mounting arms 94 and 96 are connected respectively to the handle retainer loop 70 and the rod portions 82 as more clearly seen in FIG. 6. These grid mounting arms project in diverging relationship to each other from the axial end 90 of the radiator tube so as to mount the grid 14 in close axial spaced relationship to the end 90. For best results under most conditions, the axis of the torch tube 12 may thereby be positioned below the axis of the radiator tube 72 because of the rising nature of the flame emitted by the burner unit. The torch tube 12 may be adjustably spaced from the annular shield 32 associated with the grid 14 as shown in FIGS. 5 and 6, in order to control the inflow of air with the heat energy discharged from the axial end 27 of the torch tube. Heat will be generated when the fuel supply valve 20 connected to a fuel source is opened and the burner unit ignited in a manner well-known in the art.

It will be appreciated that a plurality of radiator tubes may be assembled in series with each other to extend the heat radiating surface. Also, the radiator tube 72 could be replaced by a conventional stove pipe, with a damper controlled outlet end remote from the tube 12 enabling the venting of the space heater assembly through a fireplace or stove under emergency conditions. Further, by means of the handle assembly 26 and the handle loop formation 84, the space heater assembly shown in FIG. 5 may be moved to any desired location.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. For use with a heating device including a burner unit, an elongated torch tube secured to and enclosing the burner unit, said tube having opposite axial ends from which the burner unit projects and from which heat is emitted, respectively, and a fuel supply valve connected to the burner unit adjacent one of said axial ends of the tube from which the burner unit projects, the improvement residing in a handle assembly, means pivotally connecting the handle assembly to the tube about a single pivot axis adjacent said one of the axial ends, a support grid, and elongated slide means engageable with the tube for adjustably mounting the grid on the tube adjacent to said other of the axial ends from which heat is emitted.

2. The improvement as defined in claim 1 wherein said handle assembly includes an elongated leg element pivotally connected to the tube by said pivotal connecting means at said pivot axis, a pair of tripod legs, and hinge bracket means pivotally connecting the tripod legs to the leg element for displacement between positions parallel to the leg element and diverging therefrom.

3. The improvement as defined in claim 2 wherein said elongated slide means includes a stop portion engageable with the tripod legs in the positions thereof diverging from the leg element to form a substantially rigid and stable tripod support for the torch tube in a vertical position.

4. The improvement as defined in claim 3 wherein said elongated slide means include angularly spaced external slide rods secured to the grid and projecting axially therefrom into external engagement with the tube and clamp means for holding the rods in engagement with the tube.

5. The improvement as defined in claim 4 including an annular shield secured to said slide rods and extending axially from the grid in substantially coaxial relation to the tube.

6. The improvement as defined in claim 1 wherein said elongated slide means includes at least two angularly spaced external slide rods secured to the grid and projecting axially therefrom into external engagement with the tube and clamp means for holding the external rods in engagement with the tube.

7. The improvement as defined in claim 6 wherein the elongated slide means further includes at least one internal slide rod secured to the grid and projecting axially into internal engagement with the tube.

8. The improvement as defined in claim 7 including an annular shield secured to said slide rods and extending axially from the grid in substantially coaxial relation to the tube.

9. The improvement as defined in claim 8 including a windshield disc connected to the burner unit in close spaced relation to said one of the axial ends of the tube.

10. The improvement as defined in claim 1 including a windshield disc connected to the burner unit in close spaced relation to said one of the axial ends of the tube.

11. The improvement as defined in claim 1 including an elongated tubular radiator, protective means secured to the tubular radiator in radially spaced relation thereto, mounting means connected to the protective means and projecting axially from the tubular radiator for engagement with the grid to position the torch tube in substantially axial alignment with the tubular radiator.

12. The improvement as defined in claim 11 including an annular shield secured to said elongated slide means in axially spaced relation between the tubular radiator and said other of the ends of the torch tube for controlling inflow of air into the tubular radiator with the heat emitted from said other of the ends of the torch tube.

13. In combination with a heating device having a torch tube from which heat is emitted at one axial end and a grid secured to said torch tube in spaced relation to said one axial end, an elongated tubular radiator, protective means secured to the tubular radiator in radially spaced relation thereto, and mounting means connected to the protective means and projecting axially from the tubular radiator for engagement with the grid to position the torch tube in substantially axial alignment with the tubular radiator.

14. The combination as defined in claim 13 including an annular shield secured to said elongated slide means in axially spaced relation between the tubular radiator and said one axial end of the torch tube for controlling inflow of air into the tubular radiator with heat emitted from the torch tube.

15. The combination as defined in claim 14 including a handle assembly pivotally connected to the torch tube and a retainer secured to the protective means through which the handle assembly extends at an acute angle to the torch tube.

16. The combination as defined in claim 15 wherein said handle assembly is convertible to a tripod support supporting the torch tube in a vertical position disassembled from and independent of the tubular radiator.

* * * * *

UNITED STATES PATENT AND TRADEMARK OFFICE

CERTIFICATE OF CORRECTION

PATENT NO. : 4,364,372

DATED : December 21, 1982

INVENTOR(S) : JOSEPH N. JOHNSON

It is certified that error appears in the above-identified patent and that said Letters Patent is hereby corrected as shown below:

Column 6, line 11, claim 14, insert after "including", --elongated slide means for connecting the grid to the torch tube,--.

Signed and Sealed this

*Fourteenth* Day of *June 1983*

[SEAL]

*Attest:*

DONALD J. QUIGG

*Attesting Officer*

*Acting Commissioner of Patents and Trademarks*